US006321568B1

(12) United States Patent
Lehman

(10) Patent No.: US 6,321,568 B1
(45) Date of Patent: Nov. 27, 2001

(54) PROCESS AND APPARATUS FOR THE SEPARATION OF AIR BY CRYOGENIC DISTILLATION

(75) Inventor: Jean Yves Lehman, Maisons Alfort (FR)

(73) Assignee: L'Air Liquide, Societe Anonyme pour l'etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/705,894

(22) Filed: Nov. 6, 2000

(30) Foreign Application Priority Data

Nov. 5, 1999 (FR) ..... 99 13903

(51) Int. Cl.[7] ..... F25J 3/00

(52) U.S. Cl. ..... 62/654; 62/643

(58) Field of Search ..... 62/643, 646, 654, 62/648

(56) References Cited

U.S. PATENT DOCUMENTS 5,685,173 * 11/1997 De L'lsle et al. ..... 62/646
5,946,942 * 9/1999 Wong et al. ..... 62/643

* cited by examiner

*Primary Examiner*—William C. Doerrler
(74) *Attorney, Agent, or Firm*—Young & Thompson

(57) ABSTRACT

In a separation apparatus, a stream of liquid partially vaporizes in a heat exchanger before being sent to a phase separator. The liquid stream from the phase separator is divided into a first portion which is taken off and a second portion which is mixed with the liquid to be vaporized.

8 Claims, 1 Drawing Sheet

PROCESS AND APPARATUS FOR THE SEPARATION OF AIR BY CRYOGENIC DISTILLATION

Figure 1:
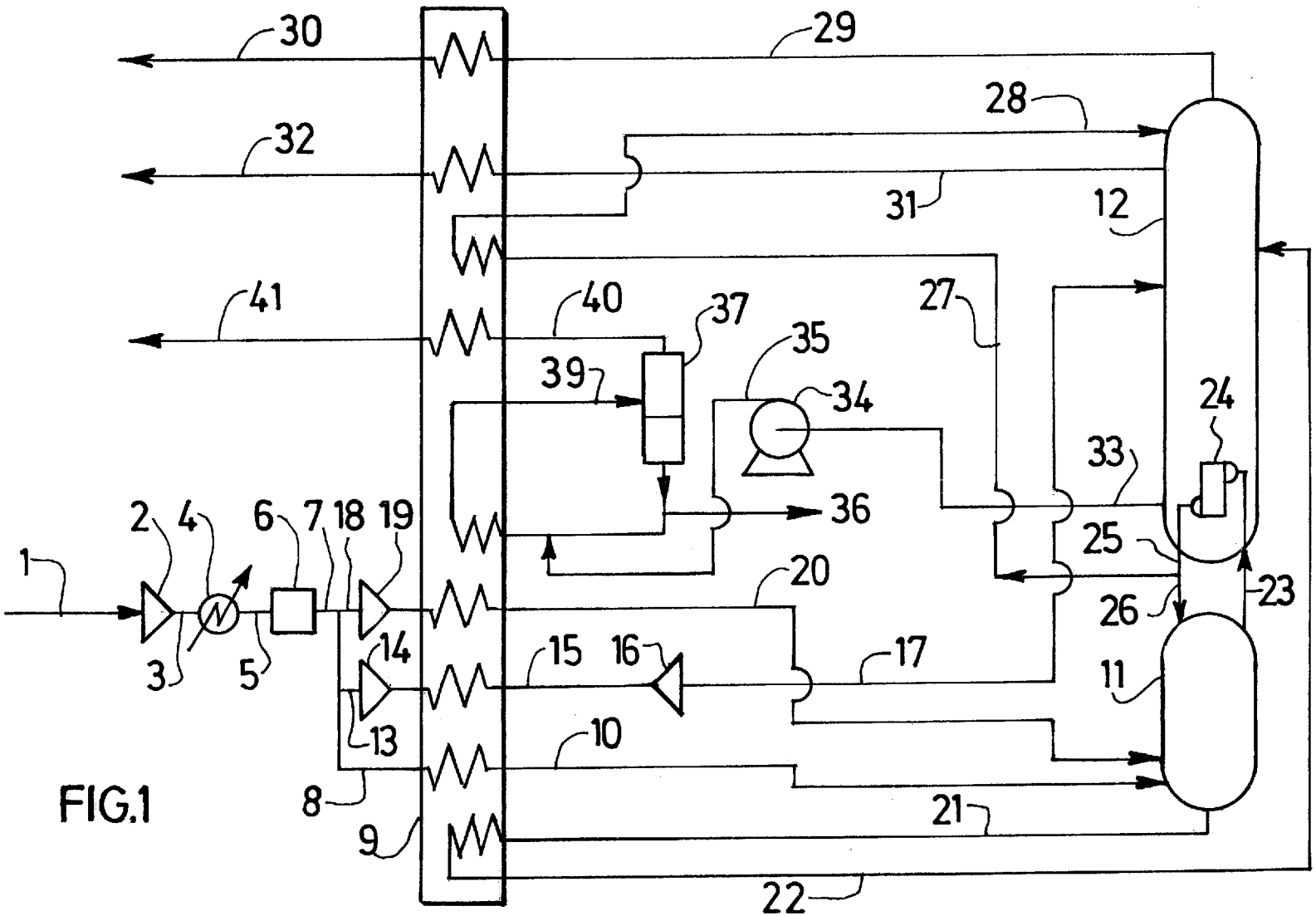

The present invention relates to a process and an apparatus for the separation of air by cryogenic distillation. In particular, it relates to a process and an apparatus for the separation of air by cryogenic distillation in which a stream of liquid, in particular a liquid comprising at least 85 mol % oxygen, coming from a cryogenic distillation column, is pressurized and vaporized by heat exchange with a stream of air intended to be distilled.

U.S. Pat. No. 5,901,578 describes an air separation process in which a stream of liquid oxygen is pumped, sent to a phase separator, sent from the phase separator to a heat exchanger, where it partially vaporizes, and sent back to the phase separator. A gas stream from the phase separator is warmed in the exchanger and serves as product. A stream of liquid oxygen is taken off as product between the pump and the phase separator.

EP-A-0,464,630 describes an air separation process in which a stream of liquid oxygen is pumped, sent to a phase separator, sent from the phase separator to a first heat exchanger, where it partially vaporizes, and sent back to the phase separator. A gas stream coming from the phase separator is warmed in a second exchanger and serves as product. A stream of liquid oxygen is taken off as product between the phase separator and the first exchanger.

The object of the invention is to improve the safety of the above processes and to reduce the size of the phase separator.

According to one subject of the invention, the process for the separation of air by distillation in order to produce a gaseous product, in which:

i) air is cooled in a heat exchanger and sent to a cryogenic distillation apparatus;

ii) the air is separated in the cryogenic apparatus in order to form oxygen-enriched and nitrogen-enriched fluids and at least one liquid;

iii) liquid is sent to the heat exchanger here it partially vaporizes;

iv) the partially vaporized stream is sent a phase separator;

v) a gas stream is withdrawn from the phase separator and warmed in a heat exchanger;

vi) one portion of the liquid stream is sent from the phase separator back to the exchanger and another portion of the liquid is taken off, is characterized in that, in step iii), the liquid is sent directly to the exchanger, possibly after having been pressurized, and is not sent to the phase separator before having been sent to the exchanger.

Optionally, all of the air intended to be distilled is sent to the exchanger where the liquid vaporizes and the gas stream from the phase separator warms up in this same exchanger.

The liquid stream coming from the phase separator is mixed with the liquid stream coming from the apparatus and intended for the exchanger downstream of the point at which the liquid stream is taken off.

The liquid taken off in step vi) is a liquid product.

Another object of the invention is to provide an air separation plant comprising:

i) an air separation apparatus comprising at least one column ii) an exchanger, means for sending an air stream to the exchanger in order to cool it and means for sending the cooled air to a column of the air separation apparatus iii) means for withdrawing a liquid from a column of the air separation apparatus iv) means for sending the liquid to the exchanger, a phase separator and means for sending the partially vaporized liquid from the exchanger to the phase separator v) means for sending a gas from the phase separator to a heat exchanger vi) means for sending one portion of the liquid from the phase separator to the exchanger and for taking off another portion of the phase separator liquid characterized in that the means for sending the liquid from the separation apparatus to the exchanger are not connected to the phase separator.

Optionally:

the plant comprises means for sending all of the air to be distilled to the exchanger;

the plant comprises means for mixing the liquid coming from the phase separator with the liquid coming from the separation apparatus upstream of the exchanger and downstream of the means for taking off the other liquid portion coming from the phase separator.

Thus it is not necessary to send all of the liquid to be vaporized from the separation apparatus to the phase separator before sending it to the exchanger.

Since the phase separator no longer receives the stream of liquid coming from the apparatus but only the partially vaporized stream coming from the exchanger, its size is reduced and its cost will be less.

The invention will now be described in greater detail with reference to FIG. 1, which is a diagram of a plant according to the invention.

The air 1 is compressed in a compressor 2, cooled at 4 and purified in the adsorbent beds 6. Next, it is divided into three. One stream 8 is sent to the medium-pressure column 11 of a double column. Another stream is supercharged in the supercharger 14, cooled in the exchanger 9, expanded in the blowing turbine 16 and sent to the low-pressure column 12 of the double column.

Other refrigeration means, such as a Claude turbine or liquid assist, could be envisaged.

Another stream of air is compressed in the supercharger 19 to a high pressure, cooled in the exchanger 9 and sent in liquid form to the medium-pressure column and the low-pressure column.

Oxygen-enriched and nitrogen-enriched liquid streams are sent from the medium-pressure column to the low-pressure column after a subcooling step (not illustrated).

A liquid stream 33 containing at least 85 mol % and preferably between 95 and 99.9 mol % oxygen is pressurized in the pump 34 to a pressure between 1 and 10 bar and sent to the exchanger 9 where it partially vaporizes. The partially vaporized stream 39 is sent to a phase separator 37. A gas stream 40 from the phase separator is sent to the exchanger 9 in order to warm up to ambient temperature.

A liquid stream from the phase separator is sent partly to the exchanger 9 after having been mixed with the pressurized liquid stream coming from the pump 34. Another liquid stream 36 is taken off either continuously or from time to time upstream of the point where the other two liquid streams mix. This other liquid stream may be a liquid product or simply a deconcentration purge in order to prevent hydrocarbons or nitrogen oxides from building up in the phase separator.

As in the process of U.S. Pat. No. 5,901,578, all of the liquid is sent to the phase separator and the liquid stream taken off upstream of the latter; there will necessarily be an increased risk of explosion.

The phase separator can be integrated with the heat exchanger.

I claim:

1. Process for the separation of air by distillation in order to produce a gaseous product, in which:

i) air is cooled in a heat exchanger (9) and sent to a cryogenic distillation apparatus (11, 12);

ii) the air is separated in the cryogenic apparatus in order to form oxygen-enriched and nitrogen-enriched fluids and at least one liquid;

iii) liquid is sent to the heat exchanger where it partially vaporizes;

iv) the partially vaporized stream (39) is sent to a phase separator (37);

v) a gas stream is withdrawn from the phase separator and warmed in a heat exchanger;

vi) one portion of the liquid stream is sent from the phase separator back to the exchanger and another portion of the liquid (36) is taken off, characterized in that, in step iii), the liquid is sent directly to the exchanger, possibly after having been pressurized, and is not sent to the phase separator before having been sent to the exchanger.

2. Process according to claim 1, in which all of the air intended to be distilled is sent to the exchanger (9) where the liquid vaporizes and the gas stream (40) from the phase separator (37) warms up in this same exchanger.

3. Process according to claim 1, in which the liquid stream coming from the phase separator (37) is mixed with the liquid stream coming from the apparatus and intended for the exchanger downstream of the point at which the liquid stream (36) is taken off.

4. Process according to claim 1, in which the liquid (36) taken off in step vi) is a liquid product.

5. Air separation plant comprising i) an air separation apparatus comprising at least one column (11, 12)

ii) an exchanger (9)

iii) means for sending a stream of air to the exchanger in order to cool it and means for sending the cooled air to a column of the air separation apparatus (11)

iv) means for withdrawing a liquid (33) from a column of the air separation apparatus v) means for sending the liquid to the exchanger (9)

vi) a phase separator (37)

vii) means for sending the partially vaporized liquid (39) from the exchanger to the phase separator viii) means for sending a gas (40) from the phase separator to a heat exchanger ix) means for sending one portion of the liquid from the phase separator to the exchanger and for taking off another portion of the phase separator liquid (36)

characterized in that the means for sending the liquid from the separation apparatus to the exchanger are not connected to the phase separator.

6. Plant according to claim 5, comprising means for sending all of the air to be distilled to the exchanger.

7. Plant according to claim 5, comprising means for mixing the liquid coming from the phase separator with the liquid coming from the separation apparatus upstream of the exchanger and downstream of the means for taking off the other liquid portion coming from the phase separator.

8. Plant according to claim 6, comprising means for mixing the liquid coming from the phase separator with the liquid coming from the separation apparatus upstream of the exchanger and downstrem of the means for taking off the other liquid portion coming from the phase separator.

* * * * *